US010796821B1

(12) United States Patent
Ku

(10) Patent No.: US 10,796,821 B1
(45) Date of Patent: Oct. 6, 2020

(54) METHOD OF MANUFACTURING POLYGONAL SHAPED AL ALLOY WIRE

(71) Applicant: Mi-Song Ku, Gyeonggi-do (KR)

(72) Inventor: Mi-Song Ku, Gyeonggi-do (KR)

( * ) Notice: Subject to any disclaimer, the term of this patent is extended or adjusted under 35 U.S.C. 154(b) by 0 days.

(21) Appl. No.: 16/430,317

(22) Filed: Jun. 3, 2019

(51) Int. Cl.

| | |
|---|---|
| ***H01B 9/00*** | (2006.01) |
| ***C22C 21/00*** | (2006.01) |
| ***H01B 5/04*** | (2006.01) |
| ***H01B 9/02*** | (2006.01) |
| ***C22F 1/04*** | (2006.01) |
| ***H01B 13/008*** | (2006.01) |

(52) U.S. Cl.
CPC ..... *H01B 9/006* (2013.01); *C22C 21/00* (2013.01); *C22F 1/04* (2013.01); *H01B 5/04* (2013.01); *H01B 9/025* (2013.01); *H01B 13/008* (2013.01)

(58) Field of Classification Search
CPC .. C22C 21/00; C22F 1/04; H01B 5/04; H01B 9/006; H01B 9/025; H01B 13/008
See application file for complete search history.

(56) References Cited

U.S. PATENT DOCUMENTS 3,711,389 A * 1/1973 Hook et al. ..... C07F 9/65814 522/89
3,770,515 A * 11/1973 Besel ..... C22C 21/00 148/690
4,347,076 A * 8/1982 Ray ..... B22F 9/00 148/437
4,397,696 A * 8/1983 Vasudevan ..... C22F 1/04 148/692
5,067,994 A * 11/1991 Brubak ..... B22F 1/004 148/415
7,615,127 B2 * 11/2009 Elder ..... H01B 5/104 148/688
9,440,272 B1 9/2016 Herrin et al.
2012/0267141 A1 * 10/2012 Kamiyama ..... C22C 47/062 174/102 R

FOREIGN PATENT DOCUMENTS

| | | |
|---|---|---|
| EP | 0787811 | 5/2000 |
| JP | 01-036751 A * | 2/1989 |
| JP | 1192896 | 4/1999 |

* cited by examiner

*Primary Examiner* — Carl J Arbes
(74) *Attorney, Agent, or Firm* — Grossman, Tucker, Perreault & Pfleger, PLLC

(57) ABSTRACT

A method for manufacturing a high conductive Al alloy wire without conducting an annealing process includes: providing an Al alloy rod comprising 0.01 parts by weight to 0.08 parts by weight of Fe, Fe:Si=2 to 3:1 of Si and the balance Al and inevitable impurities, based on 100 parts by weight of an entire A1350 alloy; conform-extruding the Al alloy rod by passing through a dies of a conform extruder having a polygonal shaped structure to form a polygonal shaped Al alloy wire; cooling the extruded Al alloy wire to room temperature; and winding the cooled Al alloy wire using a winder.

3 Claims, 6 Drawing Sheets

METHOD OF MANUFACTURING POLYGONAL SHAPED AL ALLOY WIRE

BACKGROUND

1. Field

This application relates to a method of manufacturing a polygonal shaped Al alloy wire and a power line including polygonal shaped Al alloy wires.

2. Description of Related Art

Due to rapid urbanization and industrial development, electric power demand is increasing every year. In order to cope with such an increase in electric power demand, it is required to increase the transmission/distribution capacity for smoothly transferring the power generated by a power plant to urban or industrial complexes as well as the power generation capacity of the power plant.

There are measures to increase size of transmission and distribution wires or to establish new transmission and distribution lines in order to increase the transmission/distribution capacity. However, these methods face considerable difficult situations due to the enormous budgets required to reinforce steel towers and construction of new railway lines, persuasion of residents for construction areas, and/or the like.

Thus, developing a noble way to increase transmission capacity without building new transmission towers has become a major concern for global utilities.

In this regard, replacing a power line installed in a transmission tower with a large-capacity processing power line is becoming an effective way to increase the transmission capacity while utilizing an existing transmission tower as it is.

However, as the transmission capacity of the power line increases, amount of heat generated by conducting layers also increases, which may lead to a rise in the temperature of the power line and thus deteriorate characteristics (e.g. dip) of the power line.

A great deal of development research is steadily under way on composite overhead transmission cables with high capacity and low sag which increase transmission capacity of a power line and minimize the dip even when temperature rise increases due to increase in the transmission capacity of the power line.

A conductivity of pure aluminum to which no alloy is added is about 62%. Since the pure aluminum is soft, a small amount of an alloy has been added to be used for wires to increase strength even though the conductivity becomes lowered.

A general overhead power line has a structure in which a steel core that supports the weight of the power line is placed at the center of the power line and conducting strands that transmit power surround the steel core.

Aluminum stranded conductors steel reinforced (ACSR) has been developed and widely used in power transmission lines. The ACSR consists of a solid or stranded steel core surrounded by strands of aluminum in which the steel requires tensile strength of about 125 kgf/mm$^3$ to 144 kgf/mm$^3$.

High super thermal resistant aluminum alloy conductors, invar reinforced (HSTACIR) has been also developed as a high capacity composite overhead transmission cable. The HSTACIR is constructed using an aluminum clad invar for the core with very low thermal expansion coefficient and a thermal resistant Al alloy for the conductive layer having a conductivity of 58% IACS TAI and 61% IACS STAI. The HSTACIR has excellent characteristics as a power line but it is expensive.

Aluminum conductor steel supported (ACSS) has been also developed as a high capacity composite overhead transmission cable. The ACSS is designed to increase transmission capacity at reduced sags by using a core composed of coated steel wires surrounded by one or more layers of fully annealed. Four tensile strength ratings for the steel core have been developed: SS (standard strength steel), HS (high strength steel), EHS (extra high strength steel) and UHS (ultra-high strength steel, HS285) with tensile strength from 1410 MPa to 1960 MPa. The ACSS has a continuous operating temperature rating of 200° C. while the ACSR has of 90° C. The ACSS in trapezoidal wires improves a space factor up to 93%, resulting in decrease of transmission loss, compared to the ACSR in round wires having a space factor of 75%.

However, since the ACSS uses fully annealed aluminum strands to improve the conductivity, it requires time and cost therefor.

In addition, aluminum conductor fiber reinforced (ACFR) and aluminum conductor composite core (ACFC) have been developed using composite materials for the core steel to improve the dip characteristics. However, they are less competitive in price, manufacturing them is complicated, and sufficient reliability is not ensured.

All other conductivity values are related to a standard value of conductivity for commercially pure annealed copper of $1.73\times10^{-8}$ Ωm, which is expressed as 100% IACS at 20° C.

Also, the conductivity is related to the amount of current that can flow in an aluminum conductor having the same cross-sectional area. When the conductivity is increased, more current can flow and the transmission capacity is increased. A continuous use temperature is also referred to as a heat resisting temperature. When an electric current is passed through an aluminum conductor, heat is generated due to conductor resistance. When heat is generated, it is softened and stretched due to its own weight. Accordingly, increase in the continuous use temperature or the heat-resistant temperature means that the transmission capacity is increased without loss of strength, which can be caused by heat generation, even when the conductor temperature is increased by flowing more current.

Transmission capacity is determined depending on conductivity and a continuous use temperature. It is assumed that the transmission capacity of STAL with the conductivity and continuous use temperature of 60% IACS and 210° C., respectively, is 1, the transmission capacity of XTAL with the conductivity and continuous use temperature of 58% IACS and 230° C., respectively, is 1.13 which is increased by about 13%. Thus, it is needed to increase the conductivity and the continuous use temperature in order to increase transmission capacities of overhead power lines.

However, in the case of the Al alloy, when the conductivity is increased, it is difficult to secure high temperature strength which varies depending on the continuous use temperature. On the other hand, when the high temperature strength is increased, the conductivity becomes deteriorated.

Since when impurities are added to aluminum, conductivity is lowered, alloy elements must be precipitated to the maximum through an annealing process in order to increase conductivity of Al—Zr-based aluminum alloy wires. An existing structure of Al should not change even at high temperatures in order to increase the continuous use temperature. That is, Al must have a structure that is not recrystallized.

In addition, a space factor of a conductor should be increased in order to increase the conductivity in the same size power line. The space factor means a ratio of the cross-sectional area of a conductor to a power line.

Even though the space factor is increased by changing round shapes of aluminum alloy wires to trapezoidal shapes, the aluminum wires should be fully annealed during the manufacturing process. However, in current manufacturing processes, a sufficient annealing process for the Al alloy conductor must be performed.

In JP 11-092896 and EP 0 787 811 B1, high strength heat resistant Al alloy, overhead wire and a method of preparing the Al alloy are disclosed.

In U.S. Pat. No. 9,440,272, a method for producing aluminum rod and aluminum wire is disclosed.

An aluminum conductor can be prepared by a method including producing an aluminum wire from an aluminum rod, fully annealing and stranding or by a method including fully annealing an aluminum rod, producing an aluminum wire, stranding, and stress relief heat treating.

JP 11-092896 discloses a method for preparing an aluminum alloy wire having 58% or higher of conductivity, 230° C. or higher of continuous use temperature comprising 0.29 to 1.0 wt % of Zr, 0.08 to 0.8 wt % of Fe, 0.03 to 0.4 wt % of Si, 0.004 to 0.1% of Ti and the balance Al with inevitable impurities. The method includes casting (S10), hot rolling (S20), annealing (S30) and cold rolling (S40). The aluminum wire is formed through continuous casting and rolling and the wire is annealed at a temperature of 300 to 500° C. for 6 to 250 hours to precipitate zirconium compounds. And then cold rolling is performed to provide the aluminum alloy wire having high strength. Then, the aluminum alloy wire is heat-treated for 1 to 100 hours at a temperature in the range of 200 to 450° C., if necessary, thereby improving the conductivity and heat resistance of the alloy wire.

However, the method in JP 11-092896 requires a long processing time due to annealing for a long period of time.

In order to economically increase the transmission capacity in the aluminum power line, there is a need for developing methods for manufacturing an Al alloy wire capable of increasing the space factor and reducing the manufacturing time and cost.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a method for manufacturing a high conductive Al alloy wire without conducting an annealing process includes: providing an Al alloy rod comprising 0.01 parts by weight to 0.08 parts by weight of Fe, Fe:Si=2 to 3:1 of Si and the balance Al and inevitable impurities, based on 100 parts by weight of an entire A1350 alloy; conform-extruding the Al alloy rod by passing through a dies of a conform extruder having a polygonal shaped structure to form a polygonal shaped Al alloy wire; cooling the extruded Al alloy wire to room temperature; and winding the cooled Al alloy wire using a winder.

The method for manufacturing a high conductive Al alloy wire further includes eliminating foreign substances on the Al alloy rod and preheating it to 400° C. to 500° C. before the step of conform-extruding.

When an amount of Fe is 0.08 parts by weight, Si is used in an amount of 0.026 parts by weight to 0.04 parts by weight, and the Al alloy wire has a conductivity of 63% IACS.

In another aspect, a power line including polygonal shaped Al alloy wires manufactured according to the method of this application includes: a strength steel core having a structure in which a plurality of steel wires are stranded; and a plurality of conducting layers made of a plurality of polygonal shaped Al alloy wires surrounding around the strength steel core, wherein the Al alloy wire forming a first conducting layer of the conducting layers and the Al alloy wire forming a second conducting layer of the conducting layers are each provided with a twist in an opposite direction.

The power line further includes a third conducing layer with a 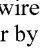 shaped cross-section and surrounding around the second conducting layer.

In further another aspect, a power line including polygonal shaped Al alloy wires manufactured according to the method of this application includes: a strength steel core having a structure in which a plurality of steel wires are stranded; a first conducting layer formed of a plurality of trapezoidal shaped Al alloy wires and surrounding over the strength steel core; and a second conducting layer formed of a plurality of 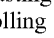 shaped Al alloy wires and surrounding over the first conducting layer.

In further another aspect, a power line including a polygonal shaped Al alloy wire manufactured according to the method of this application includes: a first conducting layer formed with four of 1/4 sphere shaped Al alloy wires; a second conducting layer formed of a plurality of trapezoidal shaped Al alloy wires and surrounding over the first conducting layer; and a third conducting layer formed of a plurality of 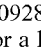 shaped Al alloy wires and surrounding over the second conducting layer.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
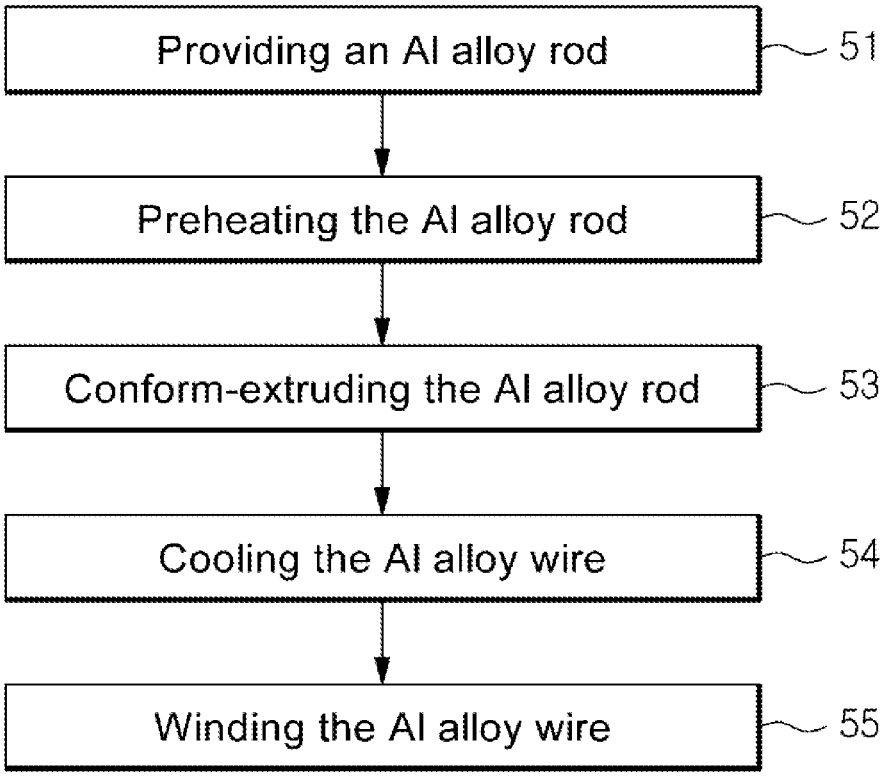
FIG. 1 is a flow diagram illustrating an example of a method of manufacturing a polygonal shaped high conductive Al alloy wire without conducting an annealing process.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

FIG. 1 is a flow diagram illustrating an example of a method of manufacturing a polygonal shaped high conductive Al alloy wire without conducting an annealing process.

Referring to FIG. 1, an example of a method of manufacturing a polygonal shaped high conductive Al alloy wire may include providing an Al alloy rod of S51, preheating the Al alloy rod of S52, conform-extruding the Al alloy rod of S53, cooling the Al alloy wire of S54 and winding the Al alloy wire S55.

The step of providing an Al alloy rod may include providing an Al alloy rod including 0.01 parts by weight to 0.08 parts by weight of Fe, Fe:Si=2 to 3:1 of Si and the balance Al and inevitable impurities, based on 100 parts by weight of an entire A1350 alloy.

Iron (Fe) may be added in an amount of 0.01 parts by weight to 0.08 parts by weight to A1350 alloy, based on 100 parts by weight of an entire A1350 alloy and Si may be added to be a ratio (parts by weight) of Fe:Si of 2 to 3:1, based on 100 parts by weight of an entire A1350 alloy. The Al alloy wire may have a conductivity of 63% IACS.

Table 1 shows the maximum allowable content (parts by weight) of the A1350 alloy and each component used in a conventional Al alloy wire.

TABLE 1

| Al | Si | Fe | Cu | Mn | Cr | Zn | B | Ga | V + Ti |
|---|---|---|---|---|---|---|---|---|---|
| 99.5 | 0.10 | 0.40 | 0.05 | 0.01 | 0..01 | 0.05 | 0.05 | 0.03 | 0.02 |

The Al alloy rod used in the step of providing of S53 may be in a coil form through a continuous casting process, a hot rolling process and a coiling process and provided to a subsequent step through an uncoiler which straightens the Al alloy rod.

The method for manufacturing a polygonal shaped high conductive Al alloy wire may further include eliminating foreign substances on the Al alloy rod and preheating to 400° C. to 500° C. (S52) before the step of conform-extruding the Al alloy rod by passing through a dies of a conform extruder.

The conform-extruding process may be applied to smaller and more precise products compared to other extruding processes and have the advantage of being able to perform operations continuously. Particularly, the conform-extruding process S53 may allow forming seamless Al alloy wires.

On the other hand, since an Al alloy rod is heated to reach a welding temperature and then extruded in an existing conform-extruding process, an extrusion speed is very low, a structure is not dense, and strength under pressure is low.

The step of preheating S52 may include preheating the Al alloy rod to 400° C. to 500° C. before supplying the Al alloy rod to the conform extruder in order to resolve such disadvantages associated with the existing conform-extruding process. When the preheating temperature is lower than 400° C., the effect of solving the above-described drawbacks is insufficient. On the other hand, when it is higher than 500° C., dents and earing defects on the overall surface may be caused.

Thus, the preheating temperature may be in a range of 400° C. to 500° C. depending on a surface condition, productivity, shape, and the like of the Al alloy wire.

Then, the conform-extruding process may be performed.

The conform-extruding process offers a technique for extruding particulate or solid feedstock into continuous rods, by using the frictional force between the metal being extruded and the walls of the extrusion chamber. Continuous extrusion is thus possible by extruding the Al alloy rod by the conform-extruding process.

In the step of conform-extruding S53, the Al alloy rod having a round cross-section may be formed into an Al alloy wire having a polygonal cross-section including a trapezoidal cross-section by passing through the Al alloy rod to dies of the conform extruder having polygonal cross-section including a trapezoidal cross-section.

The polygonal shape may include a trapezoidal shape, a 1/4 sphere shape, a  shape or the like.

Figure 2:
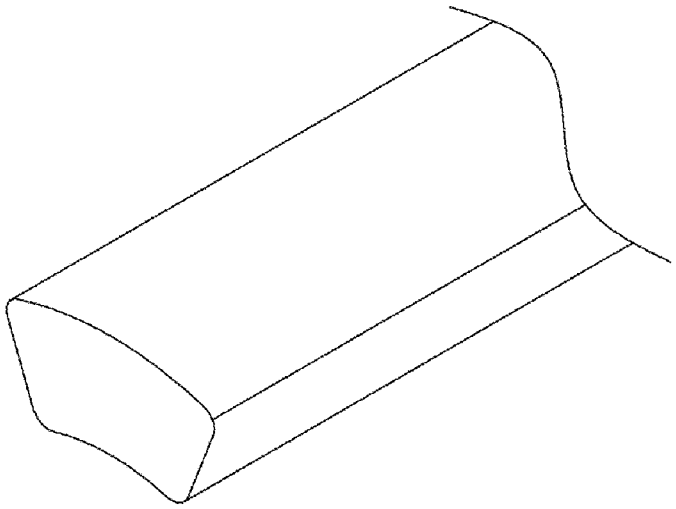
FIG. 2 is a diagram illustrating an example of a trapezoidal shaped Al alloy wire.

FIG. 2 is a diagram illustrating an example of a trapezoidal shaped Al alloy wire.

The trapezoidal shaped cross-section of the Al alloy wire may have a shape in which an upper side is formed longer than a lower side and the upper side and the lower side are formed of arcs having the same center of curvature as shown in FIG. 2.

Figure 3:
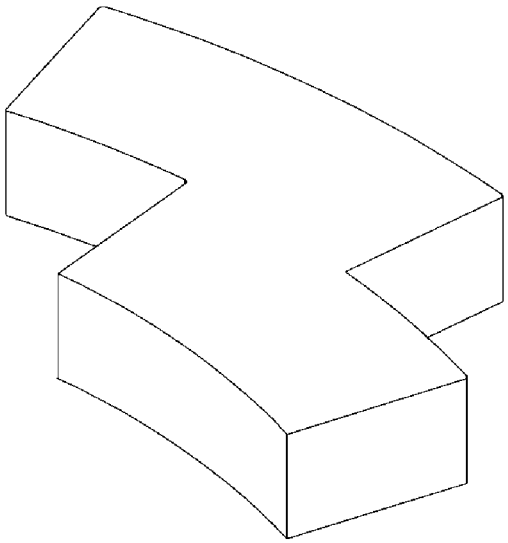
FIG. 3 is a diagram illustrating an example of a 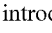 shaped Al alloy wire.

FIG. 3 is a diagram illustrating an example of a ⊂⊃ shaped Al alloy wire.

The ⊂⊃ shaped cross-section of the Al alloy wire may have a shape in which a front part of a lower side is cut and attached to a rear part of the lower side when the trapezoidal shaped cross-section is divided into four equal parts by the horizontal center line and the vertical center line.

Cooling the extruded Al alloy wire may be performed after the conform-extruding process. Since the Al alloy wire 21 from the conform extruder is in a high temperature state of 400° C. or higher, if the Al alloy wire 21 is wound in such a high temperature condition, the surface of the Al alloy wire becomes rough due to friction with a bobbin and the like and the dimensions and shape are changed, resulting in high defects. It may further cause damage to a bobbin in the subsequent winding process.

Thus, the cooling process is performed after the conform-extruding process. The cooling process is performed to cool the Al alloy wire extruded from the conform extruder to room temperature of around 15° C.

The winding the Al alloy wire may be performed using a winder.

The step of winding the Al alloy wire of S54 may facilitate carrying and storage by winding the polygonal shaped Al alloy wire, which is provided linearly through a cooler in the cooling process of S54, to the bobbin.

Table 2 shows properties of the high conductive Al alloy wire with the trapezoidal cross-sectional shape (Example 1) manufactured according to one embodiment of the present invention, in comparison with the properties of the Al alloy wires used in the ACSR (Comparison Example 1) and the HSTACIR (Comparison Example 2), respectively.

TABLE 2

| Category | Nominal diameter (mm) | Tensile strength (kgf/mm$^2$) | Conductivity (% IACS) |
|---|---|---|---|
| Comparison Example 1 | 4.5 | 16.0 | 61.0 |
| Comparison Example 2 | 4.5 | 16.0 | 61.0 |
| Example 1 | 4.5 (Converted diameter) | 7.0 | 63.0 |

A converted diameter is a measured by converting the same area into a circle.

Referring to Table 2, it is noted that the conductivity of the high conductive Al alloy wire with the trapezoidal cross-sectional shape (Example 1) is 63% IACS, which is increased by about 2% IACS, compared with those of the Al alloy wires used in the ACSR (Comparison Example 1) and the HSTACIR (Comparison Example 2).

The method for manufacturing a polygonal shaped Al alloy wire according to an embodiment of the present invention provides a high conductive Al alloy wire without performing an annealing process before and/or after the conform-extruding process.

Even though the annealing process is not performed before and/or after the conform-extruding process, the high conductivity Al alloy wire prepared according to one embodiment of the present invention has the same as or greater than the conductivity of the Al alloy wire prepared by performing the annealing process.

The high conductive Al alloy wire made according to one embodiment of the present invention may be capable of continuous extrusion without any additional annealing process of the aluminum alloy due to its O-temper (fully recrystallized temper) properties.

Hereinafter, contents of the components of the high conductive Al alloy wire manufactured without annealing process according to an embodiment of the present invention will be described.

When iron (Fe) is added to aluminum (Al), the strength is increased due to grain refinement and the like, but the conductivity can be reduced. Particularly, when the content of iron (Fe) exceeds 0.08 parts by weight, the conductivity is seriously deteriorated, and it thus requires the annealing process. On the other hand, when the content of iron is less than 0.01 parts by weight, the fluidity may be increased but the castability may be deteriorated. Therefore, it is needed to limit the content of iron (Fe) in a range of 0.01 parts by weight to 0.08 parts by weight in order to produce a highly conductive Al alloy wire which does not require the annealing process.

Silicon (Si) is added for improving the castability in the process of manufacturing the Al alloy wire 21. The castability is improved as the content of silicon (Si) is increased. However, when a ratio of the content of iron (Fe) and the content of silicon (Si) exceeds 2 to 3:1, segregation occurs and the conductivity decreases. That is, if the content of silicon (Si) is higher than the above ratio, the castability may be improved but it may cause segregation, resulting in high defect rate. On the other hand, if the content of Si is lower than the above range, it may be difficult to obtain uniform quality since the castability is lowered. Therefore, it is needed to use silicon with the content ratio of Fe:Si to be 2 to 3:1 in order to prevent from the segregation and from reduction of the conductivity while securing the castability the Al alloy wire. For example, when the content of iron (Fe) is 0.08 parts by weight, the content of silicon (Si) may be in a range of 0.026 parts by weight to 0.04 parts by weight.

Figure 4:
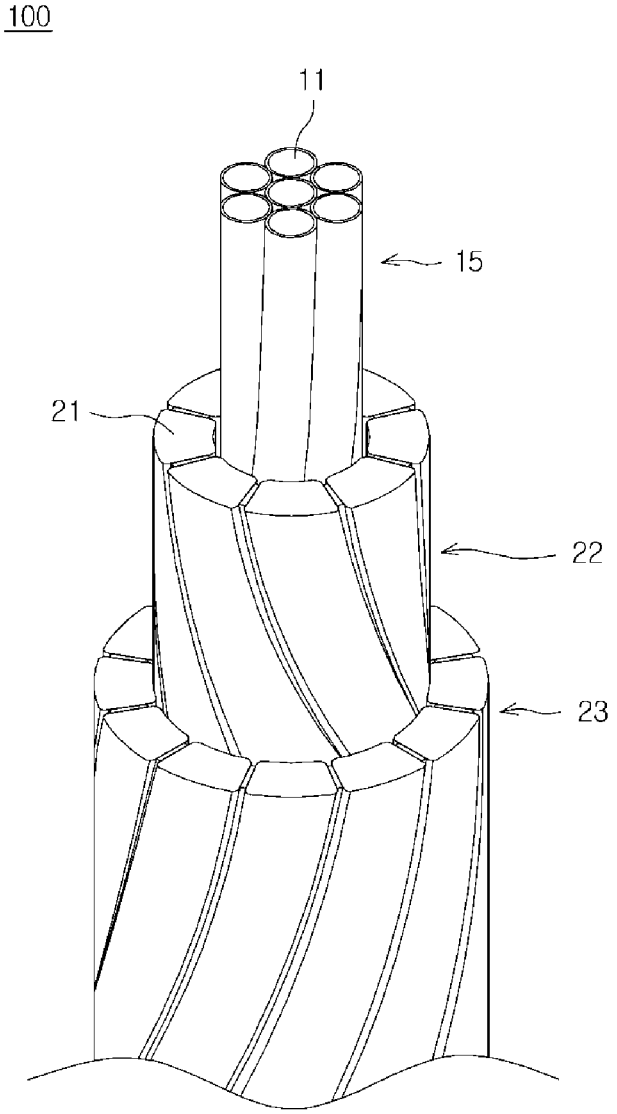
FIG. 4 is a diagram illustrating an example of an overhead power line including trapezoidal shaped Al alloy wires.
Figure 5:
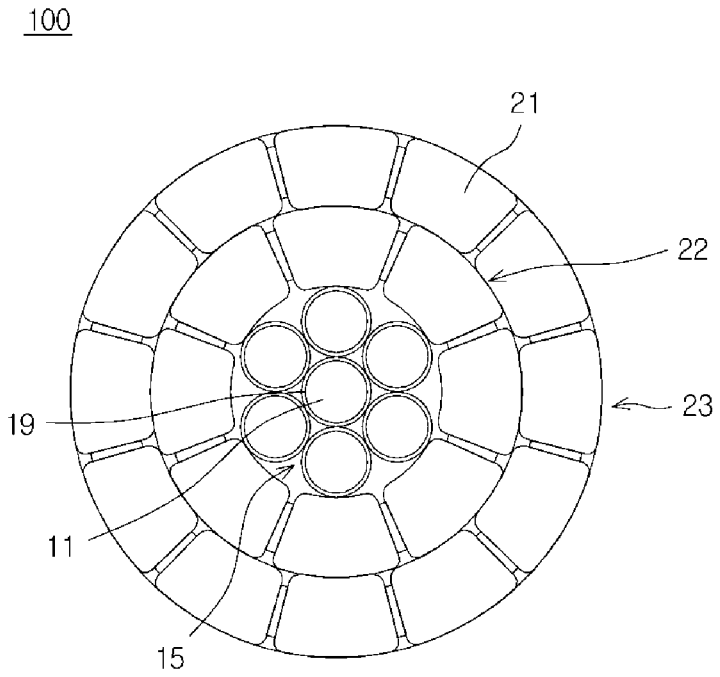
FIG. 5 is a diagram illustrating an example of a cross-sectional view of the power line of FIG. 4.

FIG. 4 is a diagram illustrating an example of an overhead power line including trapezoidal shaped Al alloy wires. FIG. 5 is a diagram illustrating an example of a cross-sectional view of the power line of FIG. 4.

A power line 100 according to FIG. 4 and FIG. 5 is provided to fit in an overhead power line capable of exhibiting a high tensile load.

Referring to FIG. 4 and FIG. 5, the power line 100 may include a strength steel core 15 and conducting layers 22 and 23.

The strength steel core 15 is disposed at the center of the power line 100 to support the overall load of the power line 100.

The strength steel core 15 may have a structure in which a plurality of steel wires 11 such as 7 steel wires are stranded. Particularly, the strength steel core 15 may be composed of one steel wire disposed at the center and the other of the steel wires 11 helically covering the center steel wire. Thus, since the plurality of steel wires 11 are tightly coupled with each other, the power line 100 may exhibit a high tensile load.

A corrosion protection layer 19 may be formed on a surface of the steel wire 11 to protect the steel wire 11 and increase durability.

The conducting layers 22 and 23 may be disposed at the outer periphery of the power line 100 to helically surround the strength steel core 15 and may provide a path for power transmission through the power line 100.

Referring to FIG. 4 and FIG. 5, the conducting layers 22 and 23 may be made of a plurality of Al alloy wires 21 helically wrapping the strength steel core 15.

The Al alloy wire 21 is made of the high conductive Al alloy wire manufactured without conducting the annealing process according to an embodiment of the present invention described above.

Referring to FIG. 4 and FIG. 5, The Al alloy wire 21 may have a trapezoidal shaped cross-section.

The Al alloy wire 21 having a trapezoidal shape according to an embodiment of the present invention may minimize the void space between the Al alloy wires 21 adjacent to each other. As a result, a space factor of the conducting layers 22 and 23 may be increased compared to the conducting layers having a round cross-section, and further, transmission loss of the power line 100 may be reduced and transmission capacity may be greatly increased.

Since a contact area between the Al alloy wires 21 adjacent to each other is also increased, a vibration fatigue limit of the power line 100 may be improved.

Referring to FIG. 4 and FIG. 5, the conducting layers 22 and 23 may include a plurality of conducting layers, for example, a first conducting layer 22 and a second conducting layer 23. The first conducting layer 22 and the second conducting layer 23 are each composed of a plurality of Al alloy wires 21.

The first conducting layer 22 may be disposed in close contact with the outer circumferential surface of the strength steel core 15 and the second conducting layer 23 may be disposed in close contact with the outer circumferential surface of the first conducting layer 22. That is, the first conducting layer 22 may be disposed between the strength steel core 15 and the second conducting layer 23. The Al alloy wires 21 forming the first conducting layer 22 and the Al alloy wires 22 forming the second conducting layer 23 are stranded in opposite directions to each other.

For example, if the Al alloy wire 21 forming the first conducting layer 22 is formed in a helical structure twisted in a clockwise direction, the Al alloy wire 21 forming the second conducting layer 23 is formed in a helical structure twisted in a counterclockwise direction, and vice versa. As a result, the helical grooves formed in the first conducting layer 22 and the second conducting layer 23 may intersect with each other, thereby enhancing the durability of the power line 100.

In addition, it is possible to prevent the unbalance of expansion/contraction associated with external conditions of an overhead power line by twisting the first conducting layer 22 and the second conducting layer 23 in an opposite direction to each other.

Figure 6:
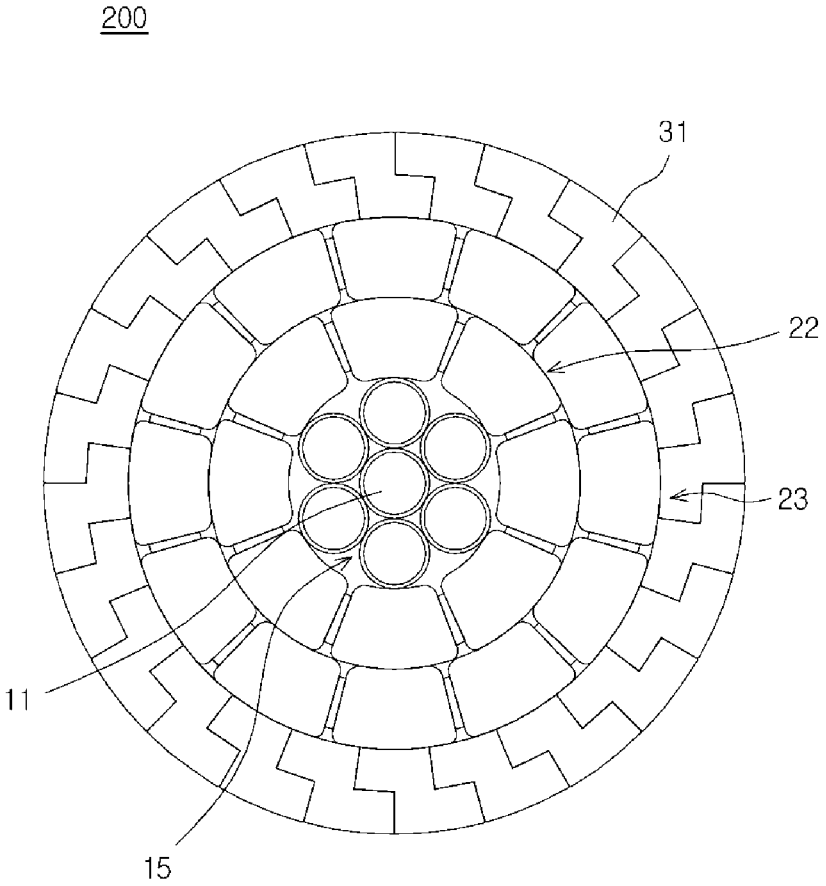
FIG. 6 is a diagram illustrating an example of a cross-sectional view of an overhead power line including polygonal shaped Al alloy wires.

FIG. 6 is a diagram illustrating an example of a cross-sectional view of an overhead power line 200 including polygonal shaped Al alloy wires.

Referring to FIG. 6, an overhead power line 200 may include a strength steel core 15 and a plurality of conducting layers 22, 23, and 31 composed of Al alloy wires helically surrounding around the strength steel core, wherein the plurality of conducting layers are formed in three layers.

A first conducting layer 22 is stranded to an opposite direction of a second conducting layer 23, and the second conducting layer 23 is stranded to an opposite direction of a third conducting layer 31. It is thus possible to prevent the unbalance of expansion/contraction associated with external conditions of an overhead power line and increase the durability of the power line 200.

Referring to FIG. 6, the conducting layers of the overhead power line 200 include the first conducting layer 22 and the second conducting layer 23, of which both have a trapezoidal cross-section, and the third conducting layer which has a ⊏ cross-section and surrounds helically the second conducting layer 23.

Figure 7:
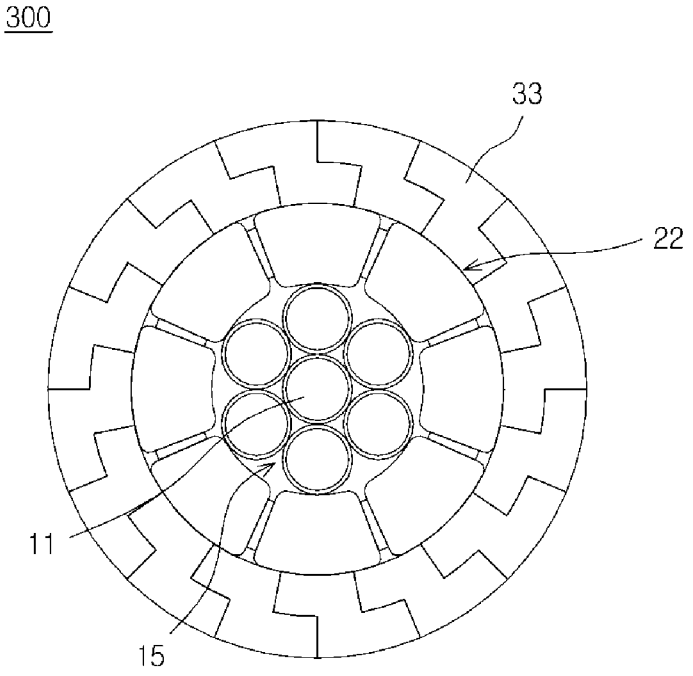
FIG. 7 is a diagram illustrating another example of a cross-sectional view of an overhead power line including polygonal shaped Al alloy wires.

FIG. 7 is a diagram illustrating another example of a cross-sectional view of an overhead power line 300 including polygonal shaped Al alloy wires.

Referring to FIG. 7, an overhead power line 300 may include a strength steel core 15, a first conducting layer 22 and a second conducting layer 33, in which the first conducting layer 22 and the second conducting layer 33 are composed of the Al alloy wires of the present invention.

Referring to FIG. 7, the first conducting layer 22 of the overhead power line 300 may have a trapezoidal cross-section and the second conducting layer 33 may have a ⊏ cross-section to helically surround over the first conducting layer 22.

The overhead power line 200 and the overhead power line 300 according to embodiments of the present invention may increase the space factor of the conducting layers, reduce transmission loss, and significantly improve transmission capacity like the overhead power line 100.

Since a contact area between the Al alloy wires 21 adjacent to each other is also increased, a vibration fatigue limit of the power line 300 may be improved.

The overhead power line 200 and the overhead power line 300 have the ⊏ shaped outmost conducting layer 31 and 33, respectively. The ⊏ shapes of each layer are interlocked with each other and thus, the contact strength is stronger than the trapezoidal shapes. Therefore, those overhead power lines 200 and 300 can be effectively used in relatively harsh environments compared to the overhead power line 100 since the interlocked forms may not be easily broken under any external force.

In addition, the multilayer power line has a form in which conductor wires of each layer are wound helically around the strength steel core. Here, when the tensile force is applied due to the installation of the power line, each layer rotates in its spiral direction. If the adhesion of the wire structure becomes weak, unbalanced rotation force may occur and the power line may be totally twisted. However, when the Al alloy wire is formed so as to have a ⊏ cross-sectional shape in the outermost layer as shown in FIG. 6 and FIG. 7, the adhesion is strengthened to prevent such problems.

Figure 8:
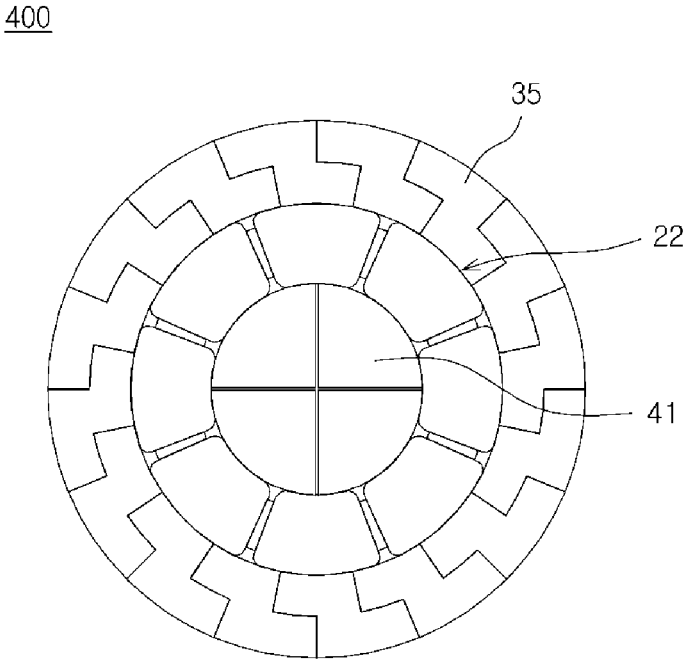
FIG. 8 is a diagram illustrating further another example of a cross-sectional view of an overhead power line including polygonal shaped Al alloy wires.

FIG. 8 is a diagram illustrating further another example of a cross-sectional view of an overhead power line including polygonal shaped Al alloy wires.

A power line 400 of FIG. 8 is developed as an underground power line.

Referring to FIG. 8, an overhead power line 400 may include a first conducting layer 41 formed with four of 1/4 sphere shaped Al alloy wires, a second first conducting layer 22 formed of a plurality of trapezoidal shaped Al alloy wires and surrounding over the first conducting layer 41, and a third conducting layer 35 formed of a plurality of ⊏ shaped Al alloy wires and surrounding over the second conducting layer.

The power line 400 of FIG. 8 is obtained by replacing the strength steel core 15 in the power line 300 of FIG. 7 with the first conducting layer 41 in which four 1/4 sphere shaped Al alloy wires are coupled.

Underground power lines do not require the tensile load like overhead power lines. Thus, four 1/4 sphere shaped Al alloy wires are combined to be the first conducting layer 41 having a circular cross-section, which increase the space factor to 95.5% from 75%.

In the embodiment of the present invention, the first conducting layer 41 is formed with four 1/4 sphere shaped Al alloy wires but it is not limited thereto. For example, the first conducting layer may be formed with from 5 1/5 sphere shaped Al alloy wires to 12 1/12 sphere shaped Al alloy wires.

Since the trapezoidal shaped Al alloy wires are arranged for the second conducting layer 22 and thus a contact area between the Al alloy wires adjacent to each other is increased, a vibration fatigue limit of the power line 400 may be improved.

In addition, since the shaped Al alloy wires are interlocked for the third conducting layer 35, it may not be easily broken under any external force.

Accordingly, it is possible to increase the space factor to reduce the transmission loss and increase transmission capacity by using Al alloy wires having a trapezoidal shaped cross-section and 63% IACS of high conductivity in the power line.

The trapezoidal shaped Al alloy wire having the conductivity of 63% IACS is prepared using an Al alloy rod having a particular composition by conducting a conform-extruding process without any annealing process before or after the conform-extruding process. Thereby, it is possible to omit the annealing process of the Al alloy wire which is required to secure a sufficient conductivity in the conventional ACSS manufacturing process, and further improve the price competitiveness of end products.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

DESCRIPTION OF REFERENCE NUMBERALS

10: Power line
15: Strength steel core
11: Steel wire
19: Corrosion protection layer
22, 23: Conducting layers
21: Al alloy wire

What is claimed is:

1. A method for manufacturing a high conductive Al alloy wire without conducting an annealing process, the method comprising:

providing an Al alloy rod comprising 0.01 parts by weight to 0.08 parts by weight of Fe, Fe:Si=2 to 3:1 of Si and the balance Al and inevitable impurities, based on 100 parts by weight of an entire A1350 alloy;

conform-extruding the Al alloy rod by passing through a dies of a conform extruder having a polygonal shaped structure to form a polygonal shaped Al alloy wire;

cooling the extruded Al alloy wire to room temperature; and winding the cooled Al alloy wire using a winder.

2. The method of claim 1, further comprising eliminating foreign substances on the Al alloy rod and preheating it to 400° C. to 500° C. before the step of conform-extruding.

3. The method of claim 1, wherein when an amount of Fe is 0.08 parts by weight, Si is used in an amount of 0.026 parts by weight to 0.04 parts by weight, and the Al alloy wire has a conductivity of 63% IACS.

* * * * *